US006312097B1

(12) United States Patent
Brugman

(10) Patent No.: US 6,312,097 B1
(45) Date of Patent: Nov. 6, 2001

(54) INK JET ARRAY

(75) Inventor: Wilhelmus T. J. Brugman, Venlo (NL)

(73) Assignee: Oce Technologies B.V., Venlo (NL)

( * ) Notice: Subject to any disclaimer, the term of this patent is extended or adjusted under 35 U.S.C. 154(b) by 0 days.

(21) Appl. No.: 09/492,360

(22) Filed: Jan. 27, 2000

(30) Foreign Application Priority Data

Jan. 26, 1999 (NL) ..... 1011130

(51) Int. Cl.[7] ..... B41J 2/145; B41J 2/15; B41J 2/05

(52) U.S. Cl. ..... 347/40; 347/65

(58) Field of Search ..... 347/40, 47, 65, 347/75, 42; 29/890.1; 408/206

(56) References Cited

U.S. PATENT DOCUMENTS

| | | | | |
|---|---|---|---|---|
| 3,988,745 | | 10/1976 | Sultan | 347/71 |
| 4,364,067 | | 12/1982 | Koto et al. | 347/70 |
| 4,396,924 | * | 8/1983 | Rosenstock | 347/68 |
| 4,449,867 | * | 5/1984 | Dergo | 408/103 |
| 6,065,909 | * | 5/2000 | Cook | 408/206 |

FOREIGN PATENT DOCUMENTS 2340855A 2/1975 (DE) .
WO 9609170A 3/1996 (WO) .

* cited by examiner

*Primary Examiner*—Thinh Nguyen
(74) *Attorney, Agent, or Firm*—Birch, Stewart, Kolasch & Birch, LLP

(57) ABSTRACT

A print head device for delivering ink to a sheet of paper or the like including a body member provided with side portions and a head surface, the head surface being disposed at an angle with respect to the side portions, an ink reservoir with an ink inlet communicating therewith, at least one ink distribution chamber communicating with the ink inlet, the body member containing a plurality of ink passages, a nozzle plate containing a plurality of substantially parallel ink delivery nozzles extending in a line from one side of the body member, the body member being provided with a plurality of ink passages extending between said ink distribution chamber and the ink delivery nozzles along both sides of the body member, a propulsion device operatively associated with said ink passages on both sides of said head surface for selectively propelling ink through the ink passages to the ink delivery nozzles, wherein the ink passages disposed at the associated sides of the body member extend parallel to each other over a path from at least the ink propulsion device to the delivery end at the ink delivery nozzles, and wherein the center lines of the delivery ends of the ink passages from both sides of the body member intersect the head surface at an angle, defining a plurality of points disposed in a line with respect to each other.

18 Claims, 4 Drawing Sheets

INK JET ARRAY

BACKGROUND OF THE INVENTION

The present invention relates to a device for delivering ink, more particularly on a print head for an ink jet printer, provided with a series of ink delivery nozzles which can be actuated selectively in the printing of a sheet of paper or the like.

The present invention also relates to an ink jet printer provided with such a print head device.

The present invention also relates to a method of making such a print head device.

A device of this kind is known inter alia from U.S. Pat. No. 4,364,067. In one embodiment, the print head comprises a base member or plate, which is substantially triangular in cross-section, and which is disposed with the apex towards the paper for printing. The device has two ink inlets situated at the top ends of the oblique sides and connected to an ink reservoir, with each leading into an ink distribution chamber, to which are connected a number of ducts formed in the associated oblique side. In the plane of the associated oblique side these ducts converge in an arc towards a number of obliquely extending ink delivery nozzles. Thus the head surface of the base plate is provided with two rows of obliquely directed ink delivery nozzles which are offset from each other.

The ducts are each provided with a constriction and a pressure chamber situated directly downstream thereof. The ducts are covered by a vibrating plate on which an electrode is disposed. At the pressure chambers, piezo-electric elements provided with an electrode are mounted on the first-mentioned electrode. By selective actuation of the piezo-electric elements the vibrating plate is pressed in locally and the volume of the pressure chamber in the required duct is reduced so that a specific quantity of ink is propelled through said duct to the associated ink delivery nozzle.

The mutually offset arrangement of the two rows of ink delivery nozzles requires a high accuracy of adjustment and operation of the known print head, particularly the height with respect to the paper. Moreover, the designing and making of the ducts in the two sides is complicated, particularly if the print head is to be very wide, for example to be able to cover a page width.

SUMMARY OF THE INVENTION

One object of the present invention is to provide an improvement in this respect by providing an improved a device for delivering ink to a sheet of paper or the like, which comprises a body with sides and a head surface disposed at an angle relative to the sides, and provided with an inlet for the ink originating from a reservoir and one or more ink distribution chambers. A number of ink delivery nozzles are situated at the head surface, and the body is provided with a number of ink passages extending between the ink distribution chambers and the ink delivery nozzles along both sides THEREOF. Ink propulsion means are disposed on the sides of the body at the ink passages for selectively propelling ink therethrough to the ink delivery nozzles. The ink passages are situated at each associated side and extend parallel to one another over the path from at least the ink propulsion means to their delivery end at the ink delivery nozzles. The center-lines of the delivery ends of the ink passages of both sides each intersect the head surface at an angle at the location of points situated in line with one another and the delivery ends are covered by a nozzle plate provided with a series of parallel ink delivery nozzles which are situated in line.

A print head constructed in such manner can be easily designed, even for large print widths, such as A4 paper, and can be easily and accurately controlled, it being possible to achieve the same pressure conditions in the mutually identical ink passages and deliver a straight line of ink with one operation.

It should be noted that U.S. Pat. No. 4,364,067 also shows an alternative construction of a print head, wherein the base plate is provided on either side with the above-described convergent ducts which terminate in a sharp point and wherein the ink delivery nozzles are defined by the vibrating plates which are extended downwardly on both sides. In this case it is intended to obtain a series of ink delivery nozzles situated in one line and delivering the ink perpendicularly. However, the accuracy of this construction leaves much to be desired.

The same patent specification shows a construction in which the base plate has parallel sides and the ducts formed in said sides connect with passages in a nozzle plate fixed on the head surface, the passages themselves having a Y-shape so that finally one in-line series of ink delivery nozzles is obtained. However, because it is complicated, it is difficult to manufacture such a nozzle plate. In addition, ink ducts connected to the same Y-shaped passage may affect one another.

It should also be noted that U.S. Pat. No. 3,988,745 discloses a print head with a base plate having parallel sides and convergent ducts form therein, the ducts being made so deep in one embodiment that their base is situated past the plane of symmetry of the base plate. The ducts end shortly before the head wall. In the head wall, or in the end wall of the ducts, holes are made to define ink delivery nozzles which are situated on a relatively straight line. However, because of the large quantity of material removed, this printer head is vulnerable. In addition, it is difficult to prevent the clogging of an ink delivery nozzle.

Where this application refers to a body or base body, this is considered to include a base body provided with a plate fixed thereon and containing the ink ducts, or a duct plate.

In producing a printer attachment with a relatively wide base plate with ink passages which may or may not be made on a separate duct plate, a wide nozzle plate and a wide piezo-electric propulsion means, the accuracy of the arrangement and the operation may be jeopardized as a result of the increased sensitivity to deviations in the alignment and the dimensioning of the various parts. This problem may be further increased if such parts are made from materials having different coefficients of expansion.

In another development of the device according to the present invention, a far-reaching solution is achieved in that the ink propulsion means are divided into a number of groups each acting on a number of ink passages situated on one and the same side and situated successively on opposite sides from each other.

In this way, the width of each group of propulsion means can be restricted and hence the sensitivity to dimensional deviations and differences in expansion with respect to the base plate and/or the passage plate can be limited. Also, this staggered arrangement can provide sufficient space for the first and last propulsion means, which would otherwise be lacking in a group-wise arrangement on one side of the duct plate or base plate.

Preferably, the ink passages subjected to the action of a group of ink propulsion means are situated directly next to one another and also situated group-wise alternately on one side and the other side, and this may be advantageous from the aspect of convenience of production.

In a further development of the device according to the present invention, the ink passages at the level of the ink propulsion means are formed as ducts and downstream thereof extend in the form of tunnels through the body to their delivery ends at the head surface. Preferably, the tunnels are straight and extend at an angle to the head surface, preferably at an angle of approximately 45° with respect to the head surface, for optimal flow conditions and production conditions.

To obviate the above-mentioned problems as a result of differences in material and considerable length, according to another feature of the present invention, the nozzle plate is provided with expansion means. In this way a long nozzle plate is divided up into smaller parts, so that the expansion length is restricted and the passages in the nozzle plate stay in front of the delivery ends.

Preferably, the expansion means are formed by interruptions in the nozzle plate obtained by removal of material therefrom after the nozzle plate has been placed on the head surface. The effect of this is that the nozzle plate can be made and fitted as a unit, but after fitting, the required expansion properties can nevertheless be obtained.

Alternatively or in a further development, the nozzle plate before fitting forms a row of elongate platelets interconnected by preferably removable or collapsible bridge parts, which preferably extend outside the head surface directly after fitting, so that they can be reached easily for any removal, full or otherwise.

In a further aspect, the present invention provides a number of ways of making the oblique tunnels in the (base) body.

In a first development, the present invention provides a method of making ink delivery holes in the head surface of a body of a print head, the ink delivery holes being inclined at a specific angle to the head surface and extending into the plane of one side of the body. Thus, a highly rigid obtuse drill is disposed at a specific angle to the head surface and the associated ink delivery hole is predrilled, and then completely drilled therethrough to the associated side. As a result of the drill rigidity, it remains in the required line during the oblique drilling operation, so that the holes are formed at the correct place.

Preferably, the actual drilling takes place with a different drill so that the preliminary drill does not need the same cross-section as the hole and can have an optimum point shape as regards the initial drilling.

Alternatively, the present invention provides a method of making ink delivery holes in the head surface of a body of a print head, the ink delivery holes being inclined at a specific angle to the head surface and extending into the plane of one side of the body, wherein use is initially made of a body which at the location of the ink delivery holes is provided with machining parts projecting from the final head surface, said machining parts being provided with surfaces perpendicular to the center-line of the holes, the holes being drilled by means of a drill disposed in each case perpendicularly to the surfaces and after drilling the machining parts are removed as far as the head surface.

In this case, counteracting any slipping of the drill during the initial drilling requires less care and no pre-drilling is required.

Preferably, use is initially made of a body with a centrally situated elevated machining part extending in the longitudinal direction of the row of required ink delivery nozzles. This facilitates drilling a row of holes which are disposed alternately to one side and to the other side of the base plate and situated with their ends in line. The machining parts can then be made throughout and straight, while in addition the quantity of material which then has to be removed after drilling is limited.

Preferably, the elevated machining part comprises two oblique surfaces directed towards either side, wherein the holes are drilled in the said surfaces along center-lines which intersect at the final head surface, as considered in a plane of projection perpendicular to the longitudinal direction of the row of holes.

The machining part can be kept small if the specified angle is 45°.

BRIEF DESCRIPTION OF THE DRAWINGS

The invention will now be explained with reference to a number of exemplified embodiments in the accompanying drawings wherein.

DETAILED DESCRIPTION OF THE INVENTION

Figure 2:
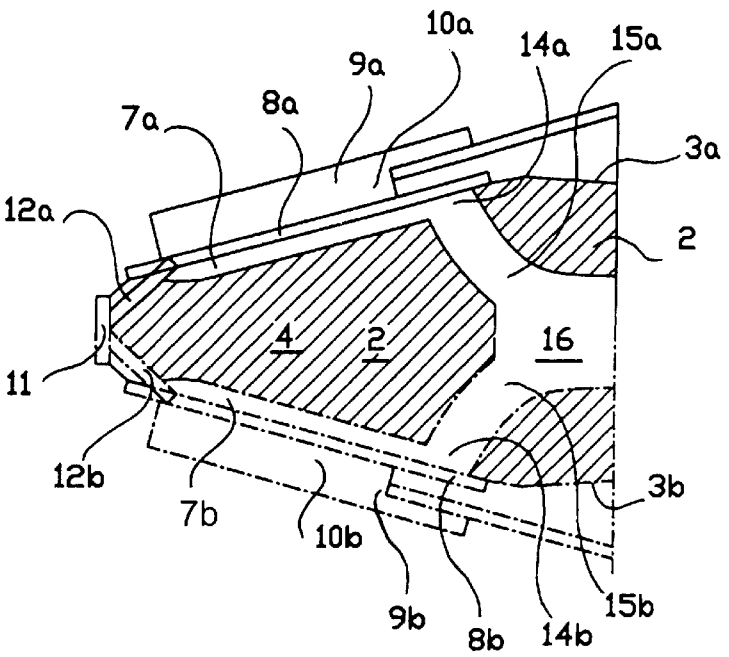
FIG. 2 is a cross-section through the print head attachment of FIG. 1.
Figure 1:
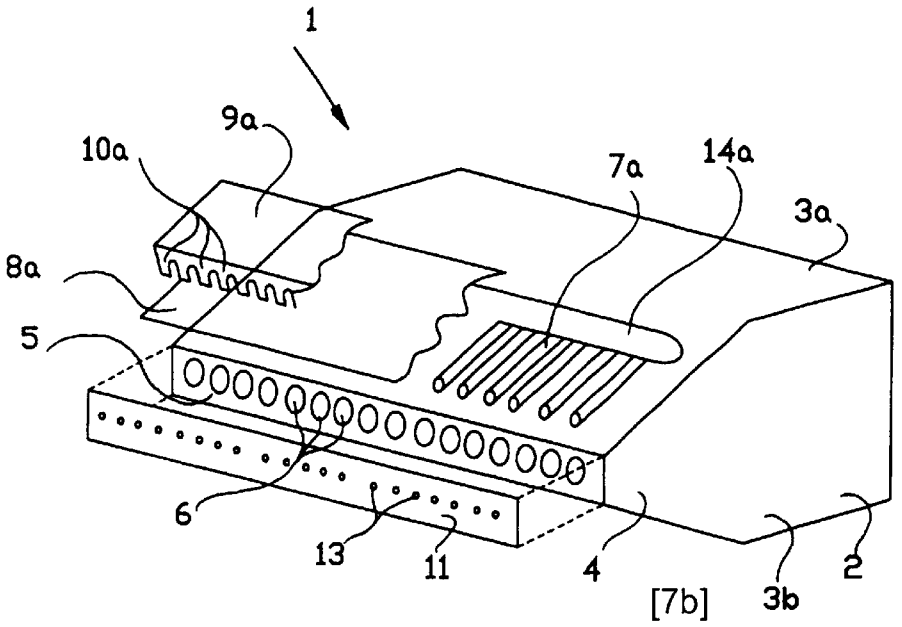
FIG. 1 is a diagrammatic perspective view of a print head attachment according to the present invention.

The print head attachment 1 shown in FIG. 1 and FIG. 2 comprises a plate 2, which is made, for example, from ceramic material and which is also referred to as the base plate. The base plate 2 has a conically tapering head end 4 and is defined inter alia by two side surfaces 3*a*, 3*b*, which are angled, and a head surface 5. Rows of parallel ink ducts 7*a, b* are formed in the side surfaces 3*a*, 3*b* forming one integrated unit consisting of the base plate and duct plates. At the upstream end, the ducts 7*a, b* are connected to a distribution chamber 14*a*, 14*b*, which is itself connected via passages 15*a*, 15*b* to an internal ink inlet 16 which is connected in the ink jet printer to an ink source. At their other end the ducts 7*a*, 7*b* communicate with tunnels 12*a*, 12*b* formed in the base plate part 4 and lead by openings 6 into the head surface 5. As shown diagrammatically, a (relatively thick, e.g. 100–200 $\mu$m) nozzle plate 11 is fixed on the head surface 5, for example by adhesion, and is provided with ink delivery nozzles 13 in line with one another.

It will also be seen that the ducts 7*a*, 7*b* are covered from the exterior by a thin (e.g. 0.02 mm thick) ink-tight and flexible foil 8*a*, 8*b*, on which piezo-electric actuators 9*a*, 9*b* are disposed, which are provided with selectively actuated legs 10*a*, 10*b*. By these means, the foil 8*a*, 8*b* can be controllably pressed, pulse-wise, to the top of the ducts 7*a*, 7*b* so that ink can be delivered from the ducts 7*a*, 7*b* through the tunnels 12*a*, 12*b* and through the ink delivery nozzles 13 to a sheet of paper disposed in front of the head surface 5.

By means of the tunnels 12*a*, 12*b* extending obliquely on the head surface 5, it is possible to have a staggered arrangement of ink access from one side to the other side of the base plate 2, 4, it being possible for the holes 6 to be situated relatively close to one another in an in-line arrangement.

Figure 3:
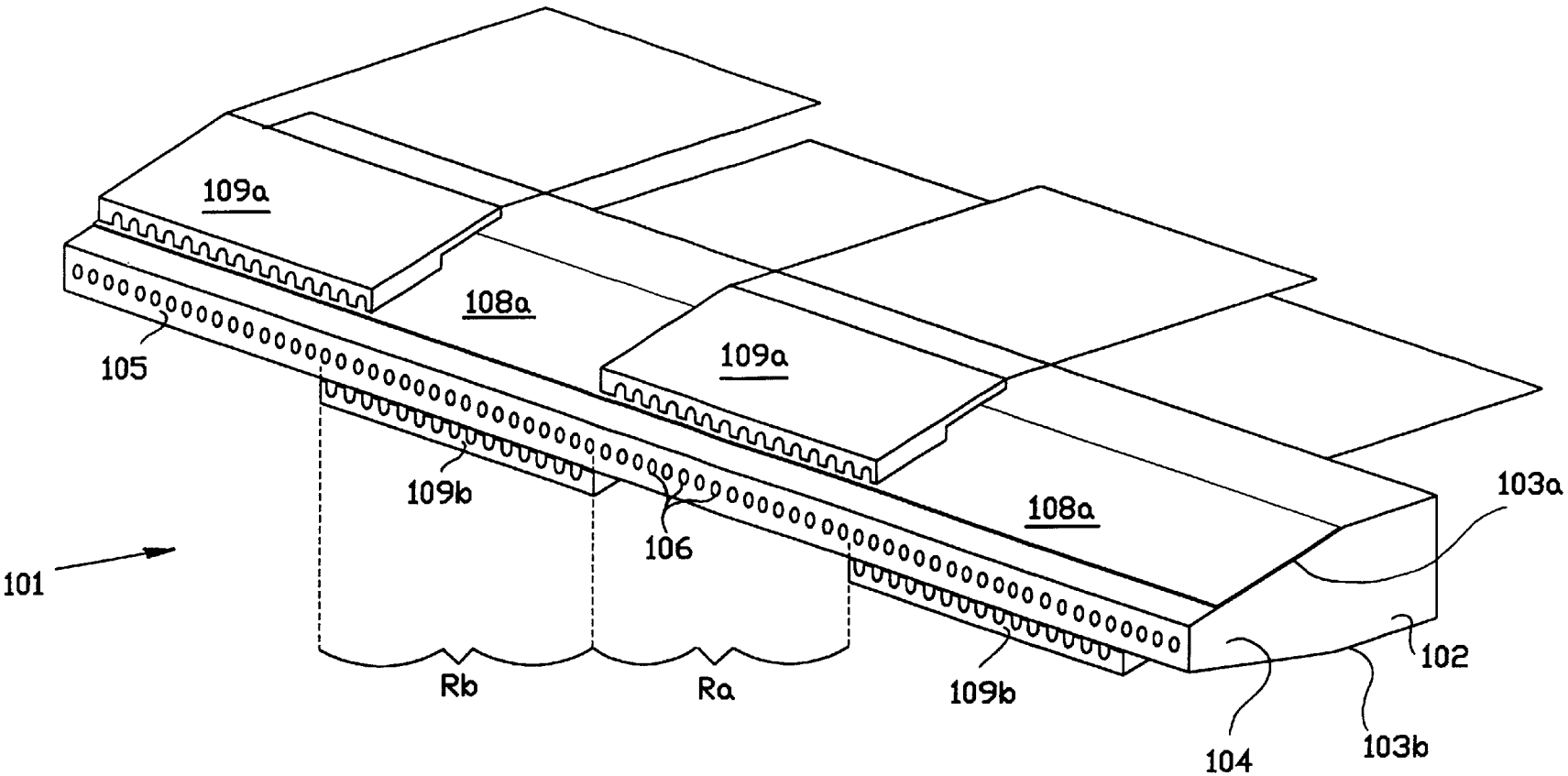
FIG. 3 shows a different embodiment of the print head attachment according to the present seen in diagrammatic perspective.

In the case of very wide print head components, for example with the width of an A4 sheet, the arrangement shown in FIG. 3 is advantageous, wherein the alternate arrangement of the ink passages on either side of the base plate 102, 104 is embodied in groups. The actuators 109*a*, 109*b* are disposed over the ducts beneath them, comparable to the ducts 7*a*, and the foil 108*a* is provided to be continuous for the sake of simplicity. The actuators 109*b* are offset on the other side of the base plate 102, 104. At this location there are rows of adjacent ducts comparable to the ducts on the other side of the base plate. The actuator 109*a* thus serves a row Ra of ink delivery holes 106 and the actuator 109*b* serves equally as a long row Rb of ink delivery holes 106. The holes 106 are disposed in line with one another in the same way as shown in FIGS. 1 and 2 and communicate via tunnels with the ducts situated respectively at the sides 103*a* and 103*b*, analogous to ducts 7*a* and 7*b* as shown in FIG. 2.

Figure 7:
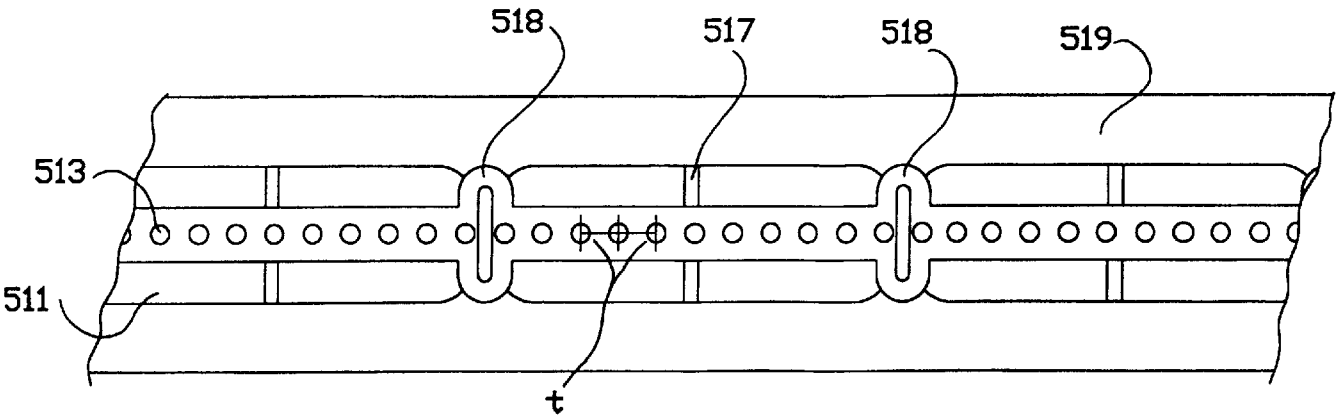
FIG. 7 shows an assembly set with a nozzle plate according to the present invention.

The nozzle plate 511 shown in FIG. 7 can be stuck to the head surface 105. The nozzle plate 511 shown in FIG. 7 is provided with a row of holes 513, situated at mutually equal distances t and forming the ink delivery nozzles. The nozzle plate 511 is interrupted at regular intervals, and these intervals may be equal to the width of the actuator shown in FIG. 3. The interruption is not complete, however, because the plate parts 511 are, in each case, interconnected by arcuate bridges 518 extending to the side. The plate parts 511 and bridges 518 are fixed on an assembly member 519 and thus are additionally connected via webs 517.

On assembly, the top of the unit as considered in the drawing is attached to the head surface 105, the holes 513 being in register with the holes 106 (FIG. 3). The assembly strip 519 with webs 517 is then removed. The bridges 518 provide room for expansion or shrinkage at the successive plate parts 511 without the latter affecting one another in so doing.

Figure 4C:
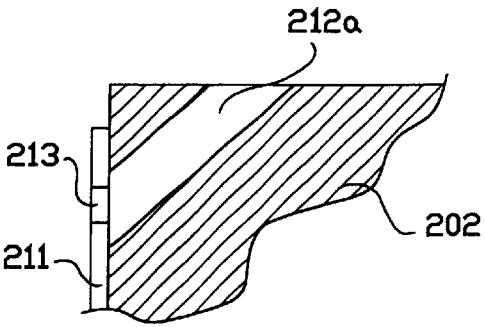
FIGS. 4A, 4B and 4C diagrammatically illustrate three successive stages in the making of an ink paint print head attachment according to the present invention.
Figure 4B:
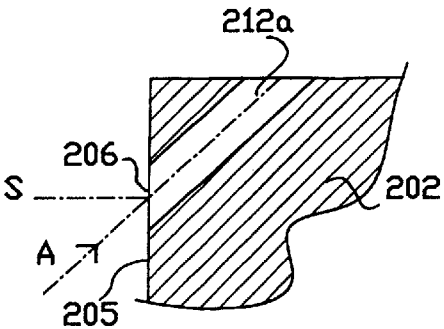
Figure 4A:
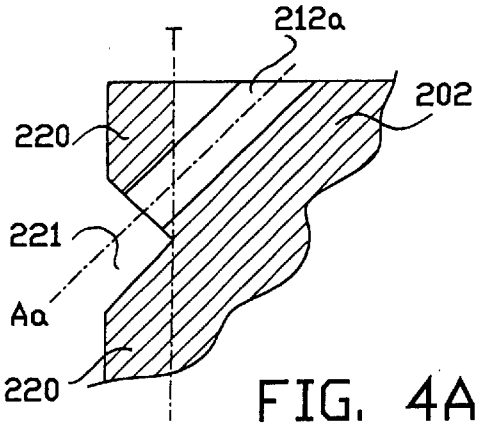

FIG. 4A is a diagram showing a part of the base plate 202, the head end being provided with machining parts 220, in which a recess 221 is formed, the surfaces being 45° to the vertical (with respect to the drawing). The tunnels 212*a* can be drilled along the center-line A, whereafter the machining parts 220 can be removed along the plane T to expose the head surface 205 as shown in FIG. 4B. The nozzle plate 211 is then attached thereto so that the ink delivery nozzles 213 are in line with the holes 206 as shown in FIG. 4B.

Figure 5:
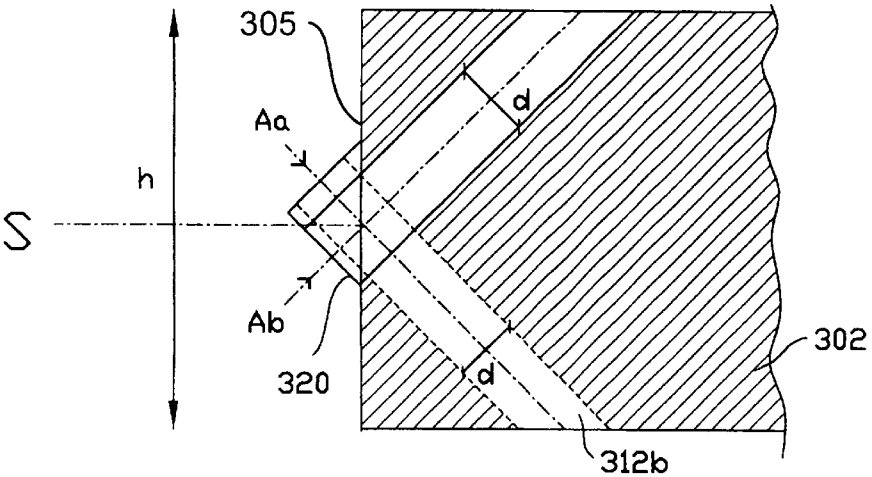
FIG. 5 is a diagram showing an alternative method of making ink passages.

FIG. 5 shows the base plate 302 provided at the head end with an elevation formed as a rib 320 of triangular cross-section, the surfaces of which are perpendicular to one another and form an angle of 45° with respect to the head surface 305. The base plate has a plane of symmetry S. Drills 320 are placed exactly at the center-lines of the required passages 312*a*, 312*b* on the surfaces of the rib 320 and then the required tunnels are drilled in the directions $A_a$ and $A_b$. By way of example, the height h of the head surface 305 may be 1.4 mm and the cross-section d of the tunnels 312*a*, 312*b* can be 250 $\mu$m, with mutual spacing of 340 $\mu$m.

Figure 6B:
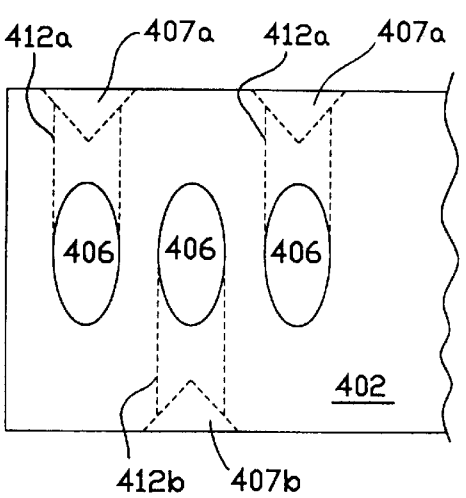
FIGS. 6A and 6B, and 6C respectively show another method of making an ink passage as viewed in the direction of the arrow VIB.
Figure 6C:
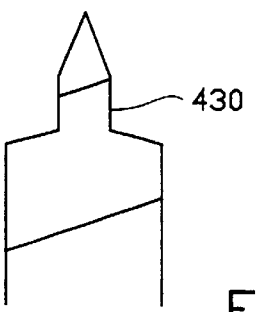
Figure 6A:
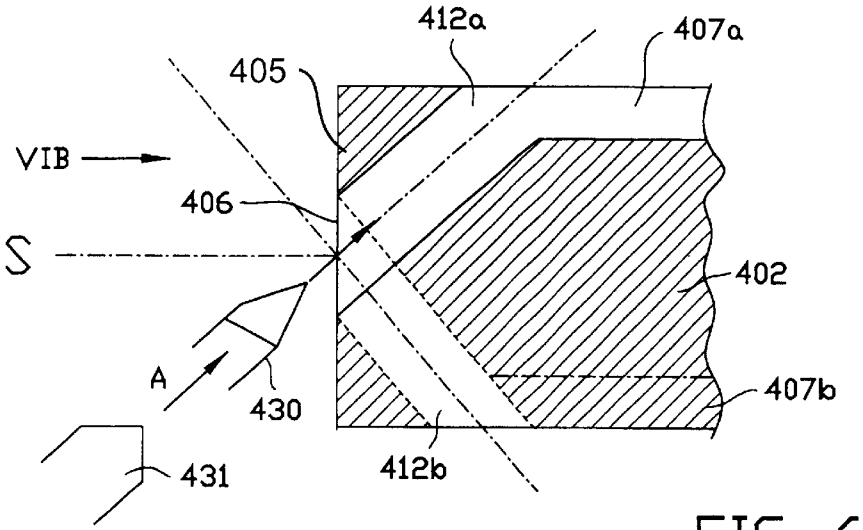

An alternative treatment is shown in FIG. 6A, in which the head surface 405 of body member 402 is not provided with an elevation or a depression, and an initial hole is drilled by means of a relatively rigid center bit 430 provided with a sharp point, and then the passage 412*a* is then drilled in comparable manner as 412*b* with a normal drill 431. In this manner delivery holes 406 are formed. An alternative is to drill the hole in one operation by means of a specially shaped drill (FIG. 6C). This drill has an attachment with a much smaller diameter and is provided with a sharp point. The top angle of this attachment is less than 90°. FIG. 6B is a more diagrammatic view showing that the tunnels 412*a*, 412*b* may extend alternately upwards and downwards to merge respectively into ducts 407*a* and 407*b* so that high density can be achieved without inadmissible loss of strength.

The invention being thus described, it will be obvious that the same may be varied in many ways. such variations are not to be regarded as a departure from the spirit and scope of the invention, and all such modifications as would be obvious to one skilled in the art are intended to be included within the scope of the following claims.

What is claimed is:

1. A print head device for delivering ink to a sheet of receiving material comprising a body member provided with sides and a head surface, said head surface being disposed at an angle with respect to the side portions, an ink reservoir with an ink inlet communicating therewith, at least one ink distribution chamber communicating with said ink inlet, said body member containing a plurality of ink passages, a nozzle plate containing a plurality of substantially parallel ink delivery nozzles extending in a line, said plurality of ink passages being extended between said ink distribution chamber and the ink delivery nozzles along both sides of said body member, ink propulsion means operatively associated with said ink passages on both sides of said body member for selectively propelling ink through said ink passages to said ink delivery nozzles, wherein the ink passages disposed at the associated sides of the body member extend parallel to each other over a path from at least the ink propulsion means to a delivery end at the ink delivery nozzles, and wherein the center lines of the delivery ends of the ink passages from both sides of the body member intersect the head surface at an angle, defining a plurality of points disposed in a line with respect to each other.

2. The device according to claim 1, wherein the ink propulsion means are separated into a plurality of separate groups each acting on a number of ink passages situated on the same side and on opposite sides of the body member.

3. The device according to claim 2, wherein the ink passages subject to the action of a group ink propulsion means are situated next to one another.

4. The device according to claim 1, wherein the ink passages in the vicinity of the ink propulsion means are formed as ducts which extend through the body downstream thereof into tunnels to respective delivery ends at the head surface.

5. The device according to claim 4, wherein the tunnels are straight and extend at an angle to the head surface.

6. The device according to claim 5, wherein the tunnels are disposed at an angle of approximately 45° with respect to the head surface.

7. The device according to claim 1, wherein the head surface and the nozzle plate have a length of the order of magnitude of a page width and wherein the nozzle plate is provided with expansion means.

8. The device according to claim 7, wherein the expansion means are formed by interruptions in the nozzle plate.

9. The device according to claim 8, wherein the nozzle plate before attachment forms a row of elongate platelets interconnected by removable or collapsible connecting parts.

10. The device according to claim 9, wherein the nozzle plate is formed by a row of elongate platelets interconnected by bridge parts which extend to the outside of the head surface after fitting.

11. A method of making ink delivery holes in a head surface of a body of a print head, which comprises positioning a highly rigid obtuse drill which is inclined at a specific angle relative to the head surface and predrilling an associated ink delivery hole into the head surface, and then completely drilling the associated ink delivery hole therethrough to the associated side.

12. The method according to claim 11, wherein complete drilling takes place with a different drill.

13. The method according to claim 11, wherein the specified angle is 45°.

14. A method of making ink delivery holes in the head surface of the body of a print head, the ink delivery holes being inclined at a specific angle relative to the head surface and extending into the plane of one side of the body, which comprises using a body which, at the location of the ink delivery holes is provided with machining parts projecting from the final head surface, said machining parts being provided with surfaces perpendicular to the center-line of the holes, the holes being drilled perpendicular to the surfaces, and after drilling, the remaining machining parts as far as the head surface.

15. The method according to claim 14, wherein use is initially made of a body with a centrally situated elevated machining part extending in the longitudinal direction of the row of required ink delivery nozzles.

16. The method according to claim 15, wherein the elevated machining part two oblique surfaces directed towards either side, wherein the holes are drilled in the said surfaces along center-lines which intersect at the final head surface, at projection perpendicular to the longitudinal direction of the row of holes.

17. The method according to claim 14, wherein the specified angle is 45°.

18. An ink jet printer containing a print head device for delivering ink to a sheet of receiving material comprising a body member provided with sides and a head surface, said head surface being disposed at an angle with respect to the side portions, an ink reservoir with an ink inlet communicating therewith, at least one ink distribution chamber communicating with said ink inlet, said body member containing a plurality of ink passages, a nozzle plate containing a plurality of substantially parallel ink delivery nozzles extending in a line, said plurality of ink passages being extended between said ink distribution chamber and the ink delivery nozzles along both sides of said body member, ink propulsion means operatively associated with said ink passages on both sides of said body member for selectively propelling ink through said ink passages to said ink delivery nozzles, wherein the ink passages disposed at the associated sides of the body member extend parallel to each other over a path from at least the ink propulsion means to a delivery end at the ink delivery nozzles, and wherein the center lines of the delivery ends of the ink passages from both sides of the body member intersect the head surface at an angle, defining a plurality of points disposed in a line with respect to each other.

* * * * *